US010827278B2

(12) United States Patent
Kong et al.

(10) Patent No.: US 10,827,278 B2
(45) Date of Patent: Nov. 3, 2020

(54) SPEAKER

(71) Applicant: AAC Technologies Pte. Ltd., Singapore (SG)

(72) Inventors: Chenliang Kong, Shenzhen (CN); Dai Feng, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/531,123

(22) Filed: Aug. 5, 2019

(65) Prior Publication Data

US 2020/0053480 A1 Feb. 13, 2020

(30) Foreign Application Priority Data

Aug. 9, 2018 (CN) ..... 2018 2 1287510 U

(51) Int. Cl.
*H04R 9/06* (2006.01)
*H04R 9/02* (2006.01)

(52) U.S. Cl.
CPC ..... *H04R 9/06* (2013.01); *H04R 9/025* (2013.01); *H04R 2400/11* (2013.01); *H04R 2499/11* (2013.01)

(58) Field of Classification Search
None
See application file for complete search history.

(56) References Cited

U.S. PATENT DOCUMENTS

2006/0067558 A1* 3/2006 Shimamura ..... H04R 31/006 381/396
2007/0274543 A1* 11/2007 Ueda ..... H04R 7/12 381/162
2009/0304223 A1* 12/2009 Chang ..... H04R 31/006 381/412
2014/0294228 A1* 10/2014 Itano ..... H04R 3/00 381/414
2014/0376766 A1* 12/2014 Chen ..... H04R 1/06 381/400
2016/0021460 A1* 1/2016 Shi ..... H04R 9/025 381/398
2018/0302722 A1* 10/2018 Linghu ..... H04R 7/18

* cited by examiner

*Primary Examiner* — Tuan D Nguyen
(74) *Attorney, Agent, or Firm* — W&G Law Group LLP

(57) ABSTRACT

The speaker of the present disclosure comprises a frame having a receiving space, a vibration system and a magnet circuit system received in the frame. The magnet circuit system comprises a lower magnetic plate, a magnet attached on the lower magnetic plate and a pole plate attached on the magnet, wherein the pole plate comprises a main body portion and a bending portion bend along a direction from an edge of the main body portion toward the lower magnetic plate, the surface of the magnet attached to the main body portion is recessed to form a recessed portion, and the bending portion is received in the recessed portion. Compared with the related art, the speaker of the present disclosure improves the performance and the competitiveness of the product.

5 Claims, 4 Drawing Sheets

SPEAKER

FIELD OF THE DISCLOSURE

The present disclosure relates to sound generator, and more particularly to a speaker in a portable electronic device.

DESCRIPTION OF RELATED ART

With the advent of the mobile Internet era, the popularity of smart mobile devices is getting higher and higher. Among many mobile devices, mobile phones are undoubtedly the most common and most portable mobile devices. At present, the functions of mobile phones are extremely diverse, and one of which is the high-quality music function. Therefore, speakers are widely applied to the current smart mobile devices.

The speaker of the related art includes a frame having a receiving space, a magnet circuit system and a vibration system housed in the receiving space of the frame. The magnet circuit system including a lower magnetic plate, a magnet attached to the lower magnetic plate and a pole plate attached to the magnet. The pole plate of the conventional structure is a flat plate. When the main magnet is raised, the peripheral sub magnet cannot increase the height synchronously due to the total height limitation of the speaker, which leads to a large drop in the Z-axis direction between the pole plate and the upper magnetic plate, and the magnet field between the edge of the pole plate and the front end of the upper magnetic plate is non-uniformity, and the BL symmetry is poor, which affects the performance of the speaker.

Therefore, it is desired to provide a speaker to overcome aforesaid problems.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

Figure 1:
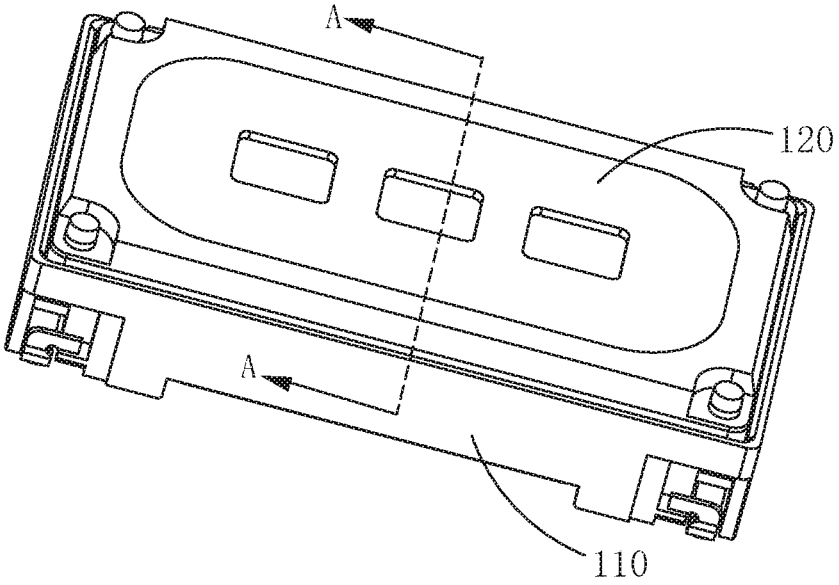
FIG. 1 is a three-dimensional diagram of structure of a speaker in accordance with an exemplary embodiment of the present disclosure.
Figure 2:
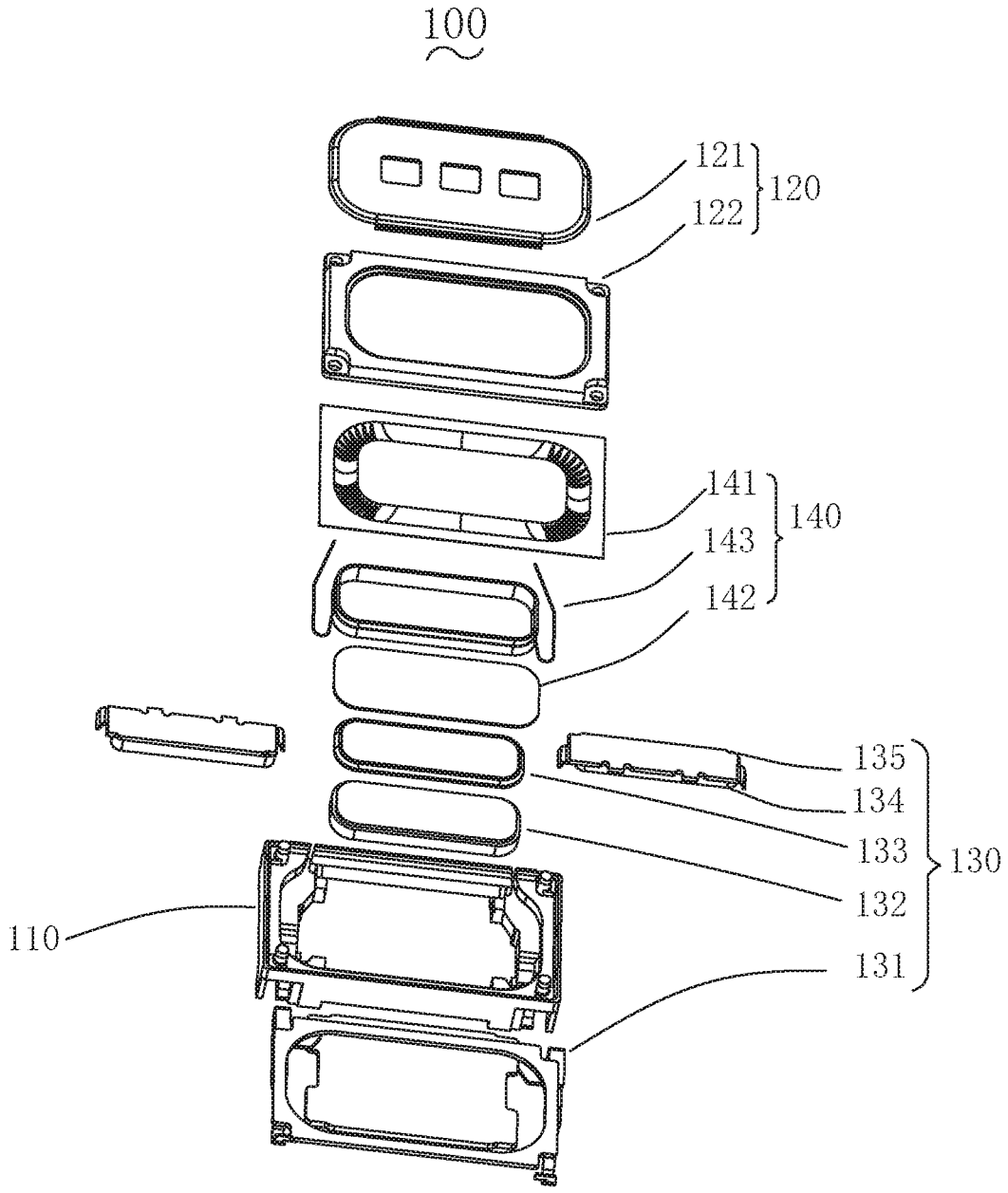
FIG. 2 is a three-dimensional diagram of the structure of the speaker exploded view showing in FIG. 1.
Figure 3:
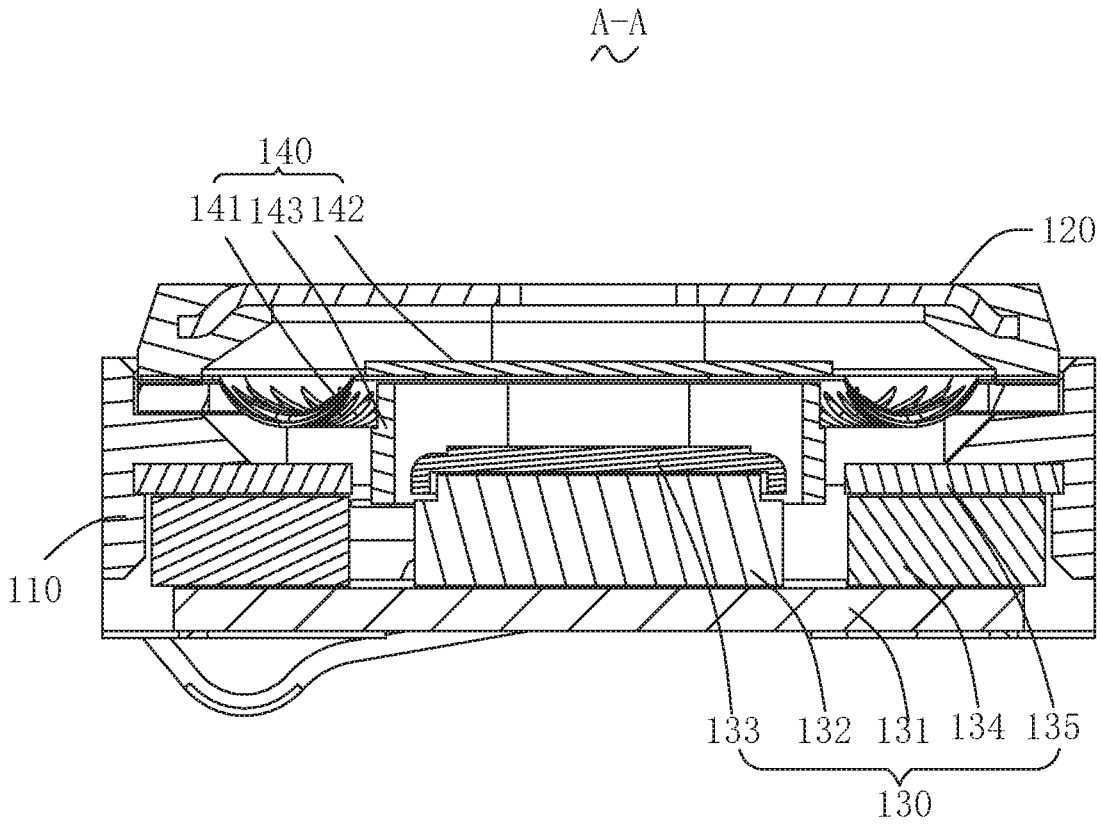
FIG. 3 is a cross-sectional diagram along the A-A line showing in FIG. 1.
Figure 4:
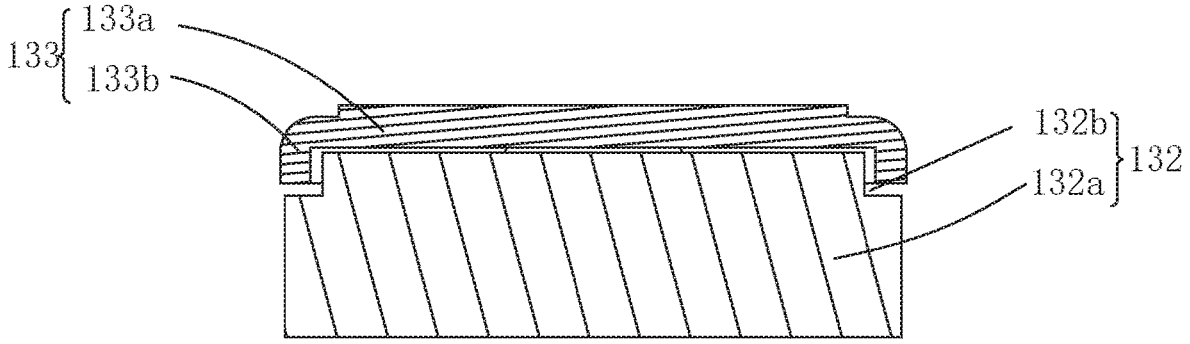
FIG. 4 is a partial view of the speaker showing in FIG. 3.

Please also refer to FIG. 1 to FIG. 4, wherein FIG. 1 is a three-dimensional diagram of structure of a speaker in accordance with an exemplary embodiment of the present disclosure; FIG. 2 is a three-dimensional perspective diagram of the structure of the speaker exploded view showing in FIG. 1; FIG. 3 is a cross-sectional diagram along the A-A line showing in FIG. 1; and FIG. 4 is a partial view of the speaker showing in FIG. 3. The present disclosure provides a speaker 100, which comprises a frame 110, a magnet circuit system 130, a vibration system 140 and a top cover 120 covering the frame 110. The frame 110 and the top cover 120 collectively enclose a receiving space for receiving the magnet circuit system 130 and the vibration system 140 of the speaker 100. The frame 110 fixedly supports the magnet circuit system 130 and the vibration system 140.

The frame 110 and the top cover 120 can also be an integral structure. In this embodiment, the top cover 120 is provided with a sound emitting hole.

Wherein, the magnet circuit system 130 includes a lower magnetic plate 131, a main magnet 132 attached to the lower magnetic plate 131 and a main pole plate 133 attached to the main magnet 132. In this embodiment, the magnet includes a main magnet 132 and a plurality of sub magnets 134. The pole plate includes a main pole plate 133 and a plurality of sub pole plate 135, and the shapes of the magnet and the pole plate are rounded rectangles. The main pole plate 133 includes a main body portion 133*a* and a bending portion 133*b* bend in the direction from an edge of the main body portion 133*a* toward the lower magnetic plate 131. The main magnet 132 including a main body portion 132*a* and a recessed potion 132*b* formed by recessed a surface of the main magnet 132 adjacent to the main body portion 133*a* of the main pole plate 133, and the bending portion 133*b* is received in the recessed portion 132*b* of the main magnet 132. The side surface of the main pole plate 133 and the side surface of the main magnet 132 are mutually uniform.

The magnet circuit system 130 further includes a plurality of sub magnet 134 attached on the lower magnetic plate 131, a plurality of the sub magnet 134 are disposed around the main magnet 132, and a magnet gap is formed between the sub magnet 134 and the main magnet 132.

It should be noted that the specific amount of the sub magnet 134 is not limited. In this embodiment, as shown in FIG. 2, the magnet circuit system 130 may include two sub magnets 134, and the two sub magnets 134 are disposed on both sides of the main magnet 132. Of course, the magnet circuit system 130 can also include more sub magnets 134 and other shapes of the sub magnet 134.

It should be further noted that sub magnets 134 may also be an integral structure, that is, the integral sub magnet 134 has a ring shape, and the main magnet 132 is received in the circular of the sub magnet 134.

The relative area between the main pole plate 133 and the main magnet 132, the sub magnet 134 is increased, so that the uniform region of the magnet induction intensity is relatively increased, which can significantly improve the magnet induction efficiency and improve the electric energy non-linear conversion, reduce harmonic distortion of the speaker, improve electromagnet induction, and improve product performance.

In the present disclosure, by providing the bending portion 133*b* and the recessed portion 132*b*, the magnet flux generated by the magnet circuit system 130 can be more effectively transmitted, so that the magnet circuit performance is better. By extending the edge of the pole plate of the speaker into the magnet gap, the magnet field distribution in the magnet gap is more uniform, and the magnet field strength in the magnet gap is more uniform under different Z-axis heights, which can improve the symmetry of the BL curve and help reduce distortion. Improve the performance of the speaker and improve the competitiveness of the product.

As shown in FIG. 2, the vibration system 140 includes a diaphragm 141, a voice coil 143 connected to the diaphragm 141 and driving the diaphragm 141 to vibrate, and a dome 142 attached to the diaphragm 141, the voice coil 143 is interposed in the magnet gap, and the diaphragm 141 includes a main body portion fixedly coupled to the dome 142 and a suspension extending outward from the main body portion and disposed around the main body portion, and some adhesive tendon is provided on the suspension of the diaphragm 141. In this embodiment, the dome 142 is attached to a side of the diaphragm 141 adjacent to the top cover 120.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker, comprising:

a frame having receiving space;

a vibration system accommodated in the receiving space;

a magnet circuit system accommodated in the receiving space, which comprises a lower magnetic plate, a magnet attached on the lower magnetic plate and a pole plate attached on the magnet, wherein the pole plate comprises a main body portion and a bending portion bend along a direction from an edge of the main body portion toward the lower magnetic plate, the surface of the magnet attached to the main body portion is recessed to form a recessed portion, and the bending portion is received in the recessed portion.

2. The speaker as described in claim 1, wherein the magnet includes a main magnet and a plurality of sub magnet disposed around the main magnet, the main magnet including the recessed portion, the pole plate including a main pole plate attached to the main magnet and a sub pole plate and a sub pole plate attached to the sub magnet, the main pole plate including a bending portion.

3. The speaker as described in claim 2, wherein the sub pole plate is a flat plate and in an annular shape.

4. The speaker as described in claim 3, wherein the side surface of the main pole plate and the side surface of the main magnet are mutually uniform.

5. The speaker as described in claim 1, wherein the speaker further comprises a top cover covering the frame, the top cover is provided with a sound emitting hole.

* * * * *